US011603174B2

(12) United States Patent
Senard et al.

(10) Patent No.: US 11,603,174 B2
(45) Date of Patent: Mar. 14, 2023

(54) BOAT LAUNCH AND RECOVERY PLATFORM AND ASSOCIATED METHOD OF LAUNCHING AND RECOVERING

(71) Applicant: TOTALENERGIES SE, Courbevoie (FR)

(72) Inventors: Etienne Senard, Pau (FR); Hubert De Brémond d'Ars, Pau (FR); Yannick Bian, Manebraz (FR)

(73) Assignee: TOTALENERGIES SE, Courbevoie (FR)

( * ) Notice: Subject to any disclaimer, the term of this patent is extended or adjusted under 35 U.S.C. 154(b) by 0 days.

(21) Appl. No.: 17/490,337

(22) Filed: Sep. 30, 2021

(65) Prior Publication Data

US 2022/0119082 A1 Apr. 21, 2022

(30) Foreign Application Priority Data

Oct. 16, 2020 (EP) ..... 20306234

(51) Int. Cl.
*B63C 3/10* (2006.01)
*B63C 3/06* (2006.01)

(52) U.S. Cl.
CPC . *B63C 3/10* (2013.01); *B63C 3/06* (2013.01)

(58) Field of Classification Search
CPC .... B63C 3/10; B63C 3/06; B63C 1/02; B63C 3/02; B63C 1/06; B63B 2027/165; B63B 27/36
See application file for complete search history.

(56) References Cited

U.S. PATENT DOCUMENTS 5,485,798 A * 1/1996 Samoian ..... B63C 1/02 405/3
5,860,765 A * 1/1999 Cruchelow ..... B63C 1/02 114/263
6,152,065 A 11/2000 Gronstrand
7,021,861 B2 * 4/2006 Basta ..... B66F 7/08 114/44
10,822,063 B1 * 11/2020 Barnes ..... B63C 1/02
11,390,363 B2 * 7/2022 Barnes ..... B63C 1/06
(Continued)

FOREIGN PATENT DOCUMENTS

KR 102034174 B1 11/2019

OTHER PUBLICATIONS

Search Report from counterpart EP 20306234.4 dated Apr. 9, 2021, 7 pages.
(Continued)

*Primary Examiner* — Carib A Oquendo
(74) *Attorney, Agent, or Firm* — Pearne & Gordon LLP

(57) ABSTRACT

The invention relates to methods of putting a boat in the water and removing the boat from the water and to a boat launch and recovery platform (1) comprising a frame (10) for receiving a boat (2), flotation means (20) fixed to the frame (10), and a floating floor (30) coupled to the frame (10) so as to be vertically translatable. The launch and recovery platform (1) is arranged for, and the methods enable, a transition from a configuration in which the floating floor (30) rests on a support floor (11) when the launch and recovery platform (1) is out of the water, to a configuration in which the floating floor (30) floats on the surface (S1) of the water when the launch and recovery platform (1) is afloat.

18 Claims, 8 Drawing Sheets

(56) References Cited

U.S. PATENT DOCUMENTS

| | | | | |
|---|---|---|---|---|
| 2008/0008528 | A1* | 1/2008 | Hey | B66F 7/0641 405/3 |
| 2016/0221644 | A1* | 8/2016 | Porak | B63C 3/12 |
| 2016/0264221 | A1* | 9/2016 | Barnes | B63C 1/02 |
| 2020/0180738 | A1* | 6/2020 | Barnes | B63C 1/06 |

OTHER PUBLICATIONS

English translation of previously submitted Search Report from counterpart EP 20306234.4 dated Apr. 9, 2021.

* cited by examiner

BOAT LAUNCH AND RECOVERY PLATFORM AND ASSOCIATED METHOD OF LAUNCHING AND RECOVERING

FIELD OF THE INVENTION

The present invention relates to the field of transport and handling of floating equipment. More particularly, the invention relates to the field of aiding the launch and recovery of a ship. In particular, it relates to a boat launch and recovery platform. The invention further relates to a method of launching and recovering from the water a boat launch and recovery platform that can be used with or without a crew on board.

PRIOR ART

The exploration of marine territories increasingly involves smaller boats that can be launched from a larger ship or from a fixed or floating marine structure.

In particular, unmanned surface vehicles are being developed for a variety of applications where manned operations may be life-threatening for the occupants. This raises the question of autonomous recovery of these unmanned surface vehicles or their storage afloat and out of water. Despite advances in recent years in unmanned surface vehicles, subsequent launching and recovery options for these vehicles have stagnated.

The launching of crafts, whether autonomous or not, generally involves the use of launch and recovery systems. As a general rule, ships or marine structures use davits or cranes to deploy crafts using cables, pulleys, hoists and hooks. For example, typically used to launch lifeboats, davits can connect to cables attached to each end of the lifeboat and launch a lifeboat. However, such a maneuver is time consuming and can be dangerous.

Rigid inflatable boats are generally deployed and recovered using a cable attached to a central pivot point of the inflatable boat and handled by a crane positioned on the ship or marine structure. During the recovery of the boats and in particular when the sea is rough, causing instability of the craft, this leads to dangerous manipulations to attach the craft to the cable.

Launch or recovery ramps have also been proposed. Ramps are generally associated with ships and cannot be easily adapted to marine structures with platforms at an altitude well above sea level. In addition, ramps are not suitable for long-term storage of the craft, either afloat or out of water.

Many operators acknowledge that launching and recovering these unmanned surface vehicles, particularly in rough seas, is difficult, limiting the overall usability of these systems. To counter this, efforts have been made to develop motion compensation systems for craft launch and recovery operations.

In particular, launch and recovery systems designed for use in rough offshore conditions have been proposed. Such systems include locking and unlocking systems for securing the craft during launch or recovery. These locking and unlocking systems include two pneumatically operated moving arms installed to provide a wider entrance point when in the open position and an additional lock when closed.

However, such systems are complex and usually require compressed air and the craft is still vulnerable to high swells during which damage to the craft can occur.

Thus, there is a need for a launch and recovery system that allows a craft to be launched and recovered safely even in rough seas, but also to be stored in optimal conditions whether afloat or out of water.

Technical Problem

The invention aims to overcome the disadvantages of the prior art. In particular, the invention aims to provide a boat launch and recovery platform providing an anchorage point at sea allowing the mooring of a boat, to facilitate its recovery by a larger motorized craft while allowing, once on land, the storage of the boat.

The invention further aims to provide a method of launching and removing from the water a boat comprised in the launch and recovery platform according to the invention.

BRIEF DESCRIPTION OF THE INVENTION

To this end, the invention relates to a boat launch and recovery platform comprising:

- a frame for receiving a boat, said frame including a profile assembly forming an enclosure comprising an entrance and a support floor,
- flotation means attached to the frame, and
- a floating floor coupled to the frame so as to be vertically translatable, preferably vertically translatable with respect to the longitudinal axis of a lower base of the frame,
- said launch and recovery platform being arranged to transition from a configuration in which the floating floor rests on the support floor when the launch and recovery platform is out of the water, to a configuration in which the floating floor floats on the surface of the water when the launch and recovery platform is afloat.

The launch and recovery platform according to the invention allows the boat to be stored on land or in the ship or marine structure from which it is launched. Out of the water, the frame can be covered with an awning for creating a protective shelter for the boat and sheltering maintenance operations.

This thus decouples the movements of the launch and recovery platform frame from the floating floor. This allows the movements of the craft (resting on the floating floor) and the frame (including the external structure) to be decoupled.

Thus, in the presence of a vertical degree of freedom of movement of the floating floor, the differences in movement between the two parts are absorbed by the movement of one in relation to the other. This allows wave-induced disturbances to be mitigated and the entire platform to be stabilized. Such a launch and recovery platform also makes it possible to relieve the bow of the boat, which is received in the platform, thus allowing spray and rainwater to be evacuated by gravity from the stern, while facilitating the boat backing out from the launch and recovery platform.

According to other optional features of the launch and recovery platform, the latter may optionally include one or more of the following features, alone or in combination:

- the frame may further include cradle-forming skids on which the ship rests when out of the water, and preferably the floating floor floats on the surface of the water independently of the cradle-forming skids.
- the frame consists of metal or a metal alloy such as steel. The metal, and in particular steel, allows the platform to withstand the weather better than polymer materials.
- it further includes a securing system, said securing system including a docking structure for the boat arranged so as to conform to the shape of part of the bow of the boat and at least two guide arms arranged to hold the boat. In this way, the safety of the boat and the control of its movement in relation to the frame is increased, even in rough seas.

the docking structure is arranged so as to be vertically translatable with respect to the lower base of the frame, preferably the docking structure is, furthermore, fixed to the floating floor. Thus, guidance and stabilization of the boat within the platform are improved.

the floating floor includes a means of attachment to the frame selected from: a slider-type connection, a ring equipped with runners sliding on a tube, a rail, or a ring capable of sliding on a vertical structure of the frame.

the floating floor comprises at least one connecting ring arranged to surround at least one guide bar fixed to the frame.

the support floor forms a cradle comprising a plurality of skids for supporting the boat when said launch and recovery platform is in an out-of-water position. Thus, the floating floor can be retracted below the level of the skids, is not crushed by the boat and has its life span increased.

the floating floor comprises a plurality of openings arranged to allow the positioning of the plurality of skids under the boat when said launch and recovery platform is in the out-of-water position. This allows for a large floating floor area to be maintained while still allowing for the existence of skids.

the floating floor is arranged so as to support the boat at least partially when said launch and recovery platform is in the out-of-water position. This keeps the boat locked by cylinders on the floating floor at the bow.

it includes a lower base, separate from the support floor, said support floor having a plane forming, with respect to the lower base, an angle greater than or equal to 10°, preferably greater than or equal to 15°, more preferably greater than or equal to 20°, still more preferably greater than or equal to 25°. For example, the angle is between 10° and 40°, preferably between 20° and 35°, even more preferably between 25° and 30°. This allows the rear part of the boat (for example the engines) to be raised, in particular to reduce the risk of tipping.

the support floor forms a cradle comprising a plurality of skids, said support floor forms the lower base of the launch and recovery platform and the plurality of skids have lengths selected so that the longitudinal axis of the boat supported by said cradle forms an angle with respect to the support floor greater than or equal to 10°. For example, the angle is between 10° and 40°, preferably between 20° and 35°, even more preferably between 25° and 30°. This allows the rear part of the boat (for example the engines) to be raised, to reduce the risk of tipping.

it includes at least one, preferably at least four lifting rings for cooperating with a lifting means.

it includes a floating cradle positioned at the entrance to the enclosure formed by the profiles of the frame, preferably fixed to at least a third profile of the profile assembly. Such a floating cradle allows at least part of the weight of the boat's engines to be supported.

it includes guide means and a plurality of fenders. This allows the bow and planking of the boat to be preserved and its insertion into the frame to be facilitated. The fenders are sized and placed to progressively guide the boat more precisely into the frame as it is inserted with the help of its motorization.

The invention also relates to a use of a launch and recovery platform according to the invention as an autonomous receptacle for a boat.

The invention further relates to a method of launching a boat by means of a launch and recovery platform according to the invention, said method comprising:

A step of hooking the launch and recovery platform according to the invention supporting the boat, and A step of putting in the water said launch and recovery platform including the boat, said step of putting in the water causing the transition from an out-of-water position in which the floating floor rests on the support floor to an afloat position in which the floating floor floats on the surface of the water and in which the boat rests at least partially on the floating floor.

Once afloat, the boat will be able to set sail quickly in a controlled manner without human presence on the boat or on the docking structure.

According to other optional features of the method of launching a boat, the latter may optionally include one or more of the following features, alone or in combination:

A step of positioning the boat in the launch and recovery platform,

A securing step including actuating the locking cylinders establishing a connection between the frame and the boat, A step of lifting, by a lifting means, said launch and recovery platform supporting the boat, A step of releasing the boat including actuating the locking cylinders. This allows the boat to exit the launch and recovery platform. These cylinders can be positioned on the platform frame, but should preferably be positioned on the boat.

The invention further relates to a method of removing a boat from the water by means of a launch and recovery platform according to the invention, said method comprising:

A step of positioning the boat on the floating floor of a launch and recovery platform according to the invention, A step of hooking, to a recovery means, said launch and recovery platform comprising the boat, A step of removing from the water, using the recovery means, said launch and recovery platform comprising the boat, said step of removing from the water causing the transition from an afloat position in which the floating floor rests substantially on the surface of the water to an out-of-water position in which the floating floor rests on the support floor.

Thanks to the angle formed by the cradle with respect to the lower floor, the boat is wedged by gravity on the front of the docking structure without the risk of sliding backwards if the locking cylinders were to open by accident.

According to other optional features of the method of removing a boat from the water, the method may include:

a step of securing the boat including actuating locking cylinders establishing a connection between the frame and the boat. These cylinders can be positioned on the platform frame, but should preferably be positioned on the boat.

Other advantages and features of the invention will appear upon reading the following description given by way of illustrative and non-limiting example, with reference to the appended figures.

Figure 1:
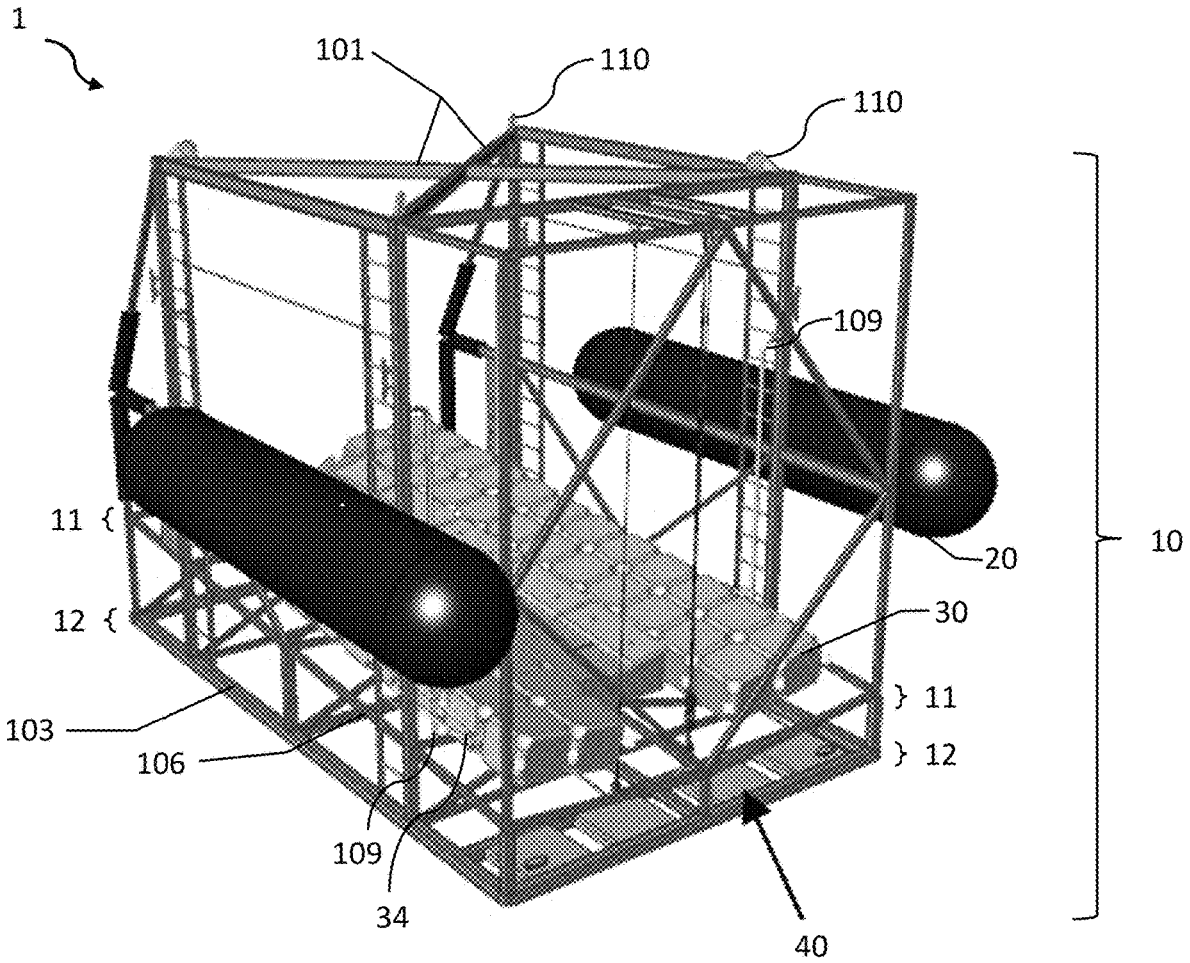
FIG. 1 shows a schematic representation of a launch and recovery platform according to an embodiment of the present invention.

Aspects of the present invention are described with reference to flowcharts and/or block diagrams of methods and apparatus (systems) according to embodiments of the invention.

In the figures, the flowcharts and block diagrams show the architecture, the functionality and the operation of possible implementations of systems, methods according to various embodiments of the present invention.

DESCRIPTION OF THE INVENTION

In the following description, the expression "profile assembly" or "profiles" refers to structural elements such as beams or bars cut to predetermined dimensions and used as a basis for mechanical structures requiring complex assembly.

The term "enclosure", within the meaning of the invention, refers to any structure adapted for receiving a boat within the structure. When the term "entrance" is used in connection with the enclosure or more generally with the launch and recovery platform, it means an opening allowing the passage of at least part of the boat inside the frame.

The term "frame", within the meaning of the invention, corresponds to an assembly of parts or elements, such as profiles for example, forming a structure adapted to receive and support a floating craft.

By "translation" is meant, within the meaning of the invention, a movement of a solid, for which each point of the solid moves along a same trajectory and at a same speed. A horizontal translation in relation to another object may, for example, correspond to a movement parallel to said other object between a first position and a second position. Conversely, a vertical translation, within the meaning of the invention, may correspond to a translational movement of a solid, for which each point of the solid moves perpendicularly with respect to another object, between a first position and a second position.

By "coupled" is meant, within the meaning of the invention, connected, directly or indirectly, with one or more intermediate elements. Two elements can be mechanically coupled.

The term "removable", within the meaning of the invention, corresponds to the ability to be detached, removed, or disassembled easily without having to destroy the means of attachment, either because there is no means of attachment or because the means of attachment can be easily and quickly disassembled (for example a notch, a screw, a tongue, a lug, a clip system). For example, by removable, is to be understood that the object is not attached by welding or any other means not intended to allow the object to be detached. Conversely, by "irremovable", is to be understood that the object is attached by welding or any other means not intended to allow the object to be detached.

By "cradle" is meant a structure supporting a boat. This may correspond to a steel frame with skids on which a boat rests.

By "boat" is meant any floating craft, whether it is autonomous or not, equipped with a hull and/or floats.

In the following description, the same references are used to designate the same elements.

As mentioned, the deployment and recovery of manned and unmanned surface vehicles (or boats) are often complex to implement in the sense that they involve a large number of personnel, necessary to secure and carry out the different steps, for the recovery or deployment of the surface vehicle. This is particularly the case when the sea is rough and the surface vehicle is subject to pitching or rolling movements, making it particularly complicated and risky for marine personnel to deploy or recover the surface vehicle.

The inventors have therefore developed a new boat launch and recovery platform. This platform can allow the deployment and recovery of a surface vehicle without direct human intervention, but also serve as a mooring point for the surface vehicle once the platform is anchored at sea, moored to a quay or once on land as a storage device for the surface vehicle.

This platform has the particularity of having a floating floor intended to support the boat at least partially when the platform is afloat. This floating floor is advantageously arranged within the platform so as to have at least one degree of freedom of vertical movement with respect to the frame. This allows effect of swell on the platform to be reduced, especially when it is supporting the boat when afloat.

In addition, the inventors have also developed a system for securing the boat, especially for use when the boat is positioned within the frame.

Thus, according to a first aspect, the invention relates to a boat launch and recovery platform 1.

In particular, and as illustrated in FIG. 1, a boat launch and recovery platform 1 according to the invention comprises a frame 10, flotation means 20, and a floating floor 30.

The frame 10 is arranged to receive a boat 2 (for example at least part of the boat 2), or more generally any floating craft, whether motorized or not, manned or unmanned. The frame is advantageously arranged to receive only part of the boat 2 leaving a portion of the boat protruding from the frame. Indeed, preferably, the platform is arranged so that a part of the boat, such as propellers positioned at the rear of the boat, is outside the frame.

In order to receive and support a boat 2, the frame 10 includes, for example, a profile assembly or any other structural element suitable for forming such a frame and in particular an enclosure suitable for receiving a boat. In particular, the enclosure shall include an opening through which a boat can pass to be housed at least partially within the frame. This entrance is preferably on one side of the frame so that the boat can enter the enclosure when it is floating on the water. In the context of the present invention, the frame may have several entrances, for example an entrance from the upper face and an entrance from the side or the rear face. Preferably, the frame has a single entrance on the rear face corresponding to the point of entrance of the boat into the frame, said entry being preferably by means of the thrust of the engines. The motors as shown in the figures shall remain outside the frame, facing upwards when the platform 1 is out of the water and downwards when the frame is afloat.

The profiles or other structural elements are advantageously designed from materials having mechanical characteristics adapted to support the load of the launch and recovery platform 1 as well as the boat 2 that said platform is intended to receive. By way of non-limiting examples, the profiles forming the frame 10 may be primarily made of metal or a metal alloy. In particular, the profiles forming the frame 10 may be made of iron or an iron alloy such as steel. Titanium or aluminum can also be used, depending on the strength required. Alternatively, the profiles or other structural elements can be made of composite materials (reinforcement and polymers) or polymers. It may also be desirable that the material of the frame 10 be corrosion resistant or protected by painting and/or cathodic protection since the platform 1 is designed to be in water for long periods (>1 month).

Advantageously, the profiles can have a thickness of at least 2 millimeters (mm), and can reach a thickness of 4 mm, 6 mm, 8 mm or more depending on the desired mechanical characteristics.

The profiles can also have a square geometry and be hollow. The steel used for the formation of the profiles can correspond to S235 or S275 steel, for example, in order to meet the standards of the offshore sector, in particular ISO EN 10855 and DNV-GL 2.7-1.

In addition, the profile assembly of the frame 10 may comprise at least one transverse beam and/or at least one rigid longitudinal beam 101 forming the upper side of the frame 10. Said rigid transverse and longitudinal beams 101 may advantageously correspond to steel metal beams of the IPN 120 (for "i" with normal profile 120) type. Preferably, the upper face comprises two rigid transverse beams 101 attached to the ends of two longitudinal beams 101, respectively, said longitudinal beams 101 being parallel to each other.

In order to allow the handling of the launch and recovery platform 1, the upper face may include at least two, preferably at least four lifting rings 110 intended to cooperate with a lifting means. Preferably, each of the rigid transverse or longitudinal beams 101 may comprise two lifting rings 110 positioned at the ends of said rigid transverse or longitudinal beams 101, respectively.

By way of illustrative examples, a lifting ring 110 may be made of S235 steel and have a hole adapted to allow coupling with a hooking device. Alternatively, a lifting ring 110 may correspond to a lifting lyre shackle made primarily of S355 steel, a wire rope sling made of S355 galvanized high strength steel, or a triple ring made primarily of S355 steel.

The frame of the platform 1 according to the invention will also include a support floor 11. Such a support floor is intended to support a floating floor integrated into the platform 1 and which will be described below.

As shown in FIG. 1, the support floor 11 may be formed from a plurality of profiles 106. Alternatively, it can be formed of one or more plates assembled so as to form a support for a floating floor.

In particular, the support floor 11 may form a cradle comprising a plurality of skids 108 for supporting the boat 2 when said launch and recovery platform 1 is in an out-of-water position. The support floor 11 may for example include at least four skids positioned so as to support the boat 2 above the floating floor when the platform 1 is out of the water.

The skids 108 can be associated with telescopic arms in order to be adapted to any type of boat. The telescopic arms may or may not be motorized and remote controlled. Additionally, in some embodiments, the skids 108 may be equipped with bearings.

The support floor 11 may be connected to a lower base 12 of the frame 10. It may, for example, be connected via profiles 106 or spacers to the lower base 12. In order to increase the mechanical strength of the frame, it may include crosspieces between the support floor 11 and the lower base 12.

The crosspieces or spacers 106 may be rigid metal tubes welded together. The support floor 11 and more generally the frame 10 may be capable of supporting a significant weight, for example more than 2 tons, preferably more than 10 tons, more preferably more than 20 tons, for example about 25 tons.

Alternatively, the support floor 11 may form the lower base 12 of the frame 10. The lower base 12 corresponds to the lower face of the frame 10. This is the face on which the platform rests when it is out of the water.

As illustrated in FIG. 1, the launch and recovery platform 1 also includes flotation means 20.

Indeed, as mentioned, the launch and recovery platform 1 may remain at sea for a long time. In addition, the design of the platform can accommodate different lengths of ships and the flotation means 20 help to maintain a parallel relationship between the upper face of the frame 10 and the waterline.

The flotation means 20 allow the platform to float on the water, but must also in combination with the floating floor ensure that the recovered boat is stabilized at sea.

The flotation means 20 may include any material that floats in the water. In particular embodiments, the flotation means 20 are made of a polymeric material such as various natural and synthetic rubbers, or open or closed cell foams. The flotation means 20 may be solid or inflatable.

Preferably, the flotation means 20 include expanded foam such as expanded polystyrene (EPS) foam.

In addition, they can be attached to the frame 10.

The flotation means 20 will be, for example, longitudinal in shape. The flotation means 20 may be sized such that when afloat, part of the flotation means 20 extends above the water surface. The flotation means 20 may in particular take the form of at least two floats 72, preferably lateral ones. In particular, the flotation means 20 may consist of two cylindrical plastic floats filled with expanded polystyrene (EPS) foam.

Figure 2:
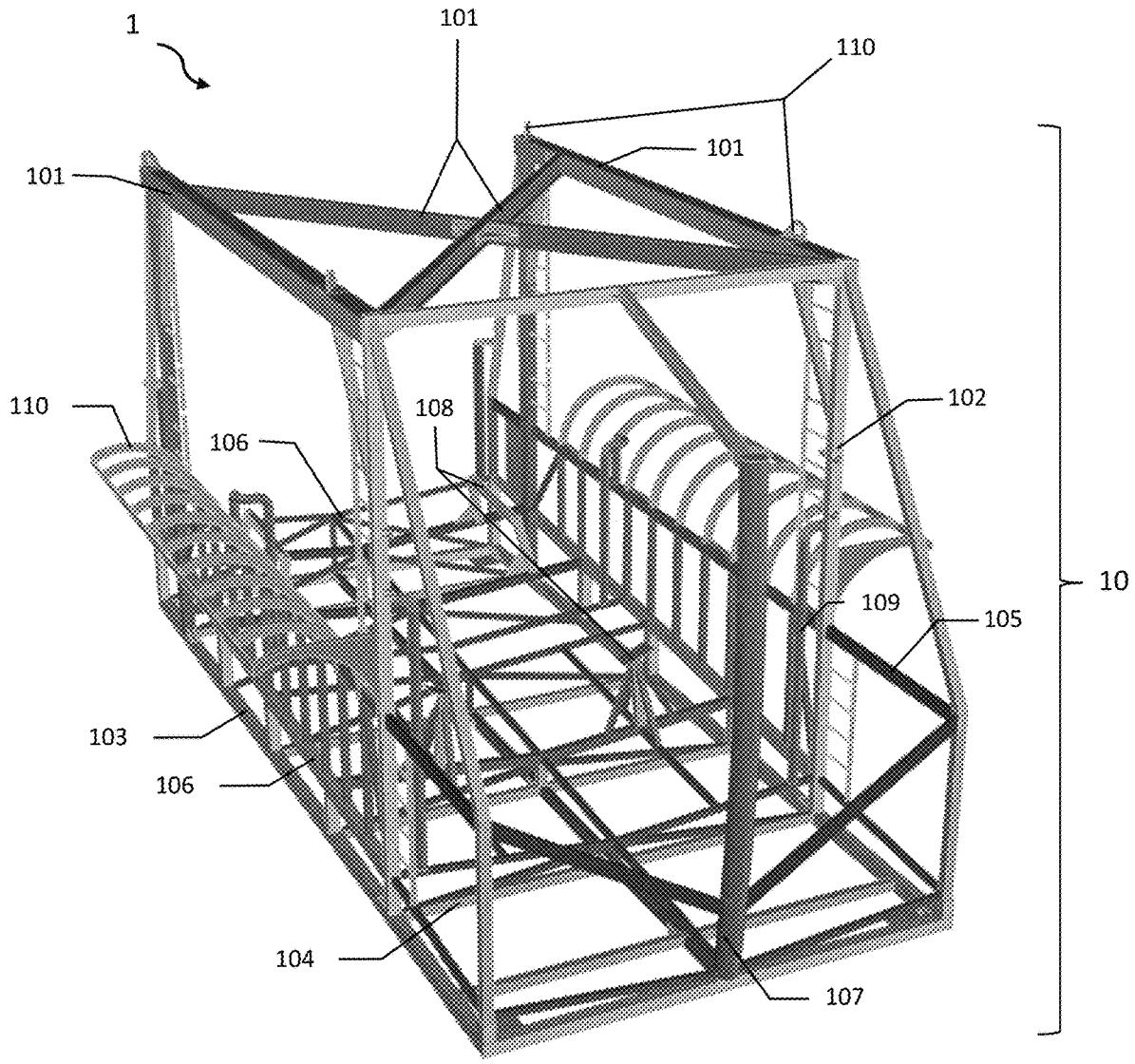
FIG. 2 shows a perspective view of a frame of a boat launch and recovery platform according to an embodiment of the present invention.

The flotation means 20 may be permanently or removably attached to the frame 10. In one embodiment, as illustrated in FIG. 2, the frame may include profiles 110 arranged so as to be able to crimp the flotation means 20 at least partially.

The launch and recovery platform 1 also includes a floating floor 30 illustrated in particular in FIG. 1.

As already presented, the floating floor 30 is essential. It will be arranged within the platform 1 so as to support, at least partially, the boat 2 when the platform 1 is afloat. Advantageously, it will support the front part of the boat 2 and will have a degree of freedom of vertical movement with respect to the frame 10 allowing it to float freely on the surface of the water independently of the vertical movements of the frame 10.

Thus, a floating floor 30 according to the invention will be coupled to the frame 10 so as to be vertically translatable, in particular with respect to the frame, such as with respect to the support floor 11 or the lower base 12.

The floating floor 30 may also be coupled to the frame 10 so as to be additionally horizontally translatable, in particular with respect to the support floor 11. This is particularly apparent in FIG. 1. The floating floor 30 is herein coupled to the frame 10 by an attachment means 34 which may take the form of a connecting ring 34 arranged to surround at least one guide bar 109 attached to the frame 10. Thus, the floating floor 30 is advantageously equipped with an attachment means 34 allowing freedom of movement with respect to the frame 10. Nevertheless, as will be shown later, the horizontal translation movements of the floating floor can be limited by a securing system 3 of the boat 2.

The attachment means 34 according to FIG. 1 may have any form of opening at the connecting ring with, for example, an elliptical or parallelepiped opening. In particular, the attachment means 34 according to FIG. 1 has a parallelepiped-shaped opening at the connection ring, which also allows a horizontal translation of the floating floor 30 with respect to the support floor 11 or the lower base 12.

Furthermore, since the width of the opening of the connecting ring 34 is somewhat larger than the diameter of the guide bar 209, then the floating floor 30 also has a small amount of transverse movement relative to the support floor 11 or the lower base 12.

The floating floor 30 may also be coupled to the frame 10 by means of a slider-type connection, a ring equipped with a polymer skid (for example high density or medium density polyethylene, polyamide) sliding on a vertical structure acting as a rail, or a combination of rings and bars fixed to the frame.

Advantageously and more preferably, the floating floor 30 will be coupled to the frame 10 by means of a combination of rings, preferably fixed to the floating floor, and bars, preferably fixed to the frame. This embodiment allows for reduced backlash to improve guiding accuracy.

The floating floor 30 is intended to support the boat 2 at sea at least partially. Thus, it has dimensions adapted to this function. In particular, it may have a surface area in contact with water greater than 2 $m^2$, preferably greater than 10 $m^2$, more preferably greater than 15 $m^2$, even more preferably greater than 25 $m^2$.

Furthermore, the floating floor 30 may have a thickness greater than 10 cm, preferably greater than 20 cm, more preferably greater than 30 cm.

It may be made like the flotation means 20 of any material floating in the water. In particular embodiments, the floating floor 30 is made of a polymeric material such as various natural and synthetic rubbers, or open or closed cell foams. Preferably, the floating floor 30 is formed from floating modular blocks. These blocks can be nested together to form the floating floor 30. Alternatively, the floating floor can be a wood-epoxy composite floor or a rotomolded plastic form.

The floating floor 30 may form a flat structure. Nevertheless, it preferably forms a structure with at least two planes and more preferably several planes so as to follow at least partially the shape of the hull of the boat 2. In addition, it may include openings for the passage of vertical bars involved in the vertical translation of the floating floor or for the passage of the skids 108 associated with the cradle.

Thus, the floating floor 30 may include a plurality of openings arranged to allow the positioning of the plurality of skids 108 on the boat 2 when said launch and recovery platform 1 is in the out-of-water position.

In the context of the present invention, the launch and recovery platform 1 is advantageously arranged to transition from a configuration in which the floating floor 30 rests on the support floor 11 when the launch and recovery platform 1 is out of the water, to a configuration in which the floating floor 30 floats on the water surface S1 when the launch and recovery platform 1 is afloat.

Figure 7:
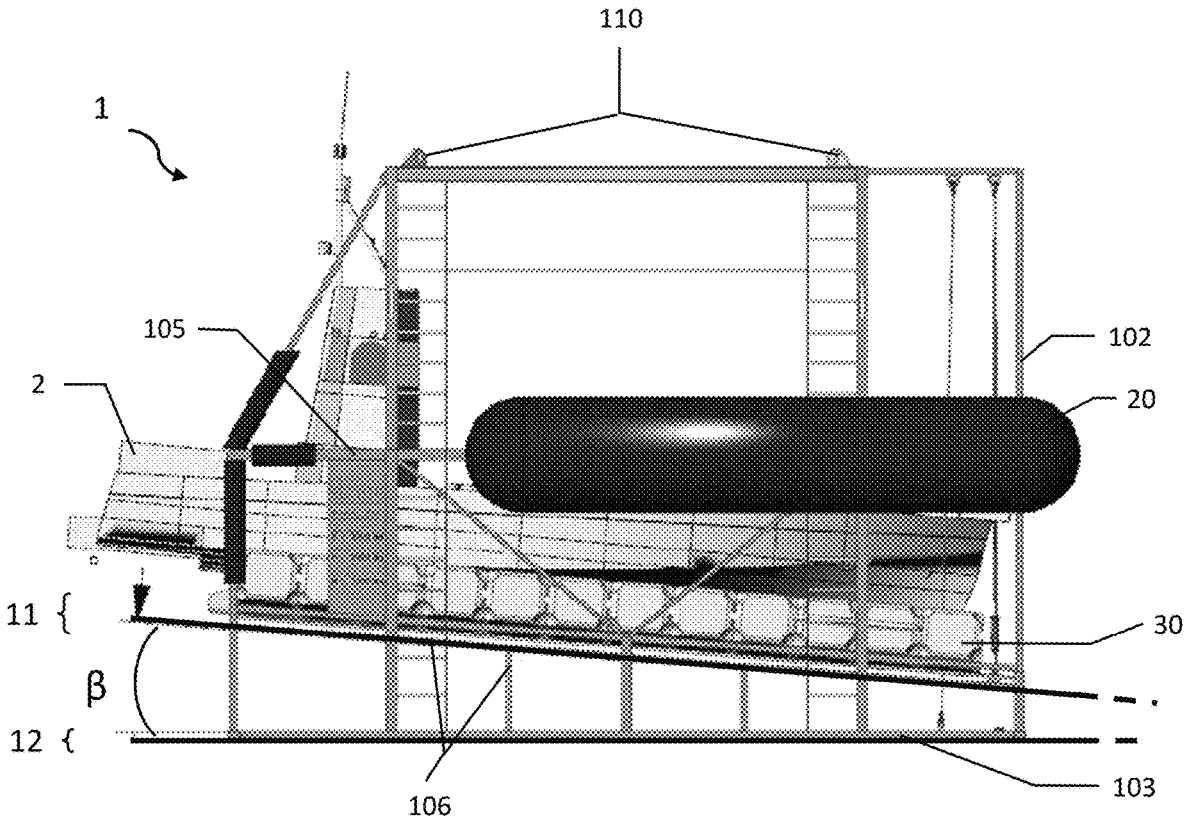
FIG. 7 shows a side view of a boat launch and recovery platform according to an embodiment of the present invention when the platform is out of the water.
Figure 8:
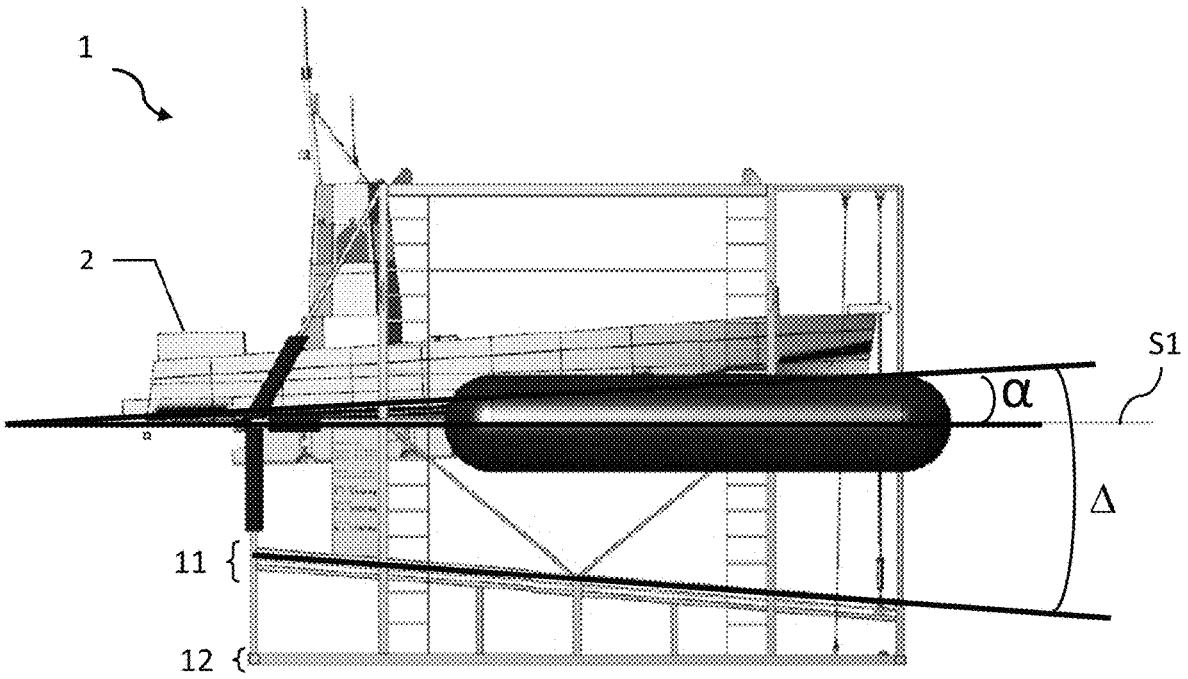
FIG. 8 shows a side view of a boat launch and recovery platform according to an embodiment of the present invention when the platform is afloat.

This is illustrated in particular in FIGS. 7 and 8.

In FIG. 7, the launch and recovery platform 1 is out of the water. Gravity thus induces the positioning of the floating floor 30 on the support floor 11. As regards the boat, it rests on the floating floor 30. Alternatively, if skids 108 are present across the floating floor 30, the boat 2 may rest on the skids 108.

As illustrated, the launch and recovery platform 1 may include a lower base 12, separate from the support floor 11. This lower base 12 may be formed of profiles. It is part of the frame 10 and advantageously constitutes the part of the frame 10 resting on the ground (for example a dock or a ship's platform).

In this configuration, the support floor 11 will advantageously have a plane forming, with respect to the lower base 12, an angle β greater than or equal to 10°, preferably greater than or equal to 15°, more preferably greater than or equal to 20°, even more preferably greater than or equal to 25°. This angle β will generally be less than 60°. Preferably, the angle may be between 10° and 45°, preferably between 20° and 30°, even more preferably between 25° and 35°. When the floating floor is not formed of a single plane then the angle is preferably calculated between the longitudinal axis of the floating floor and a plane formed by the lower base 12.

Figure 3:
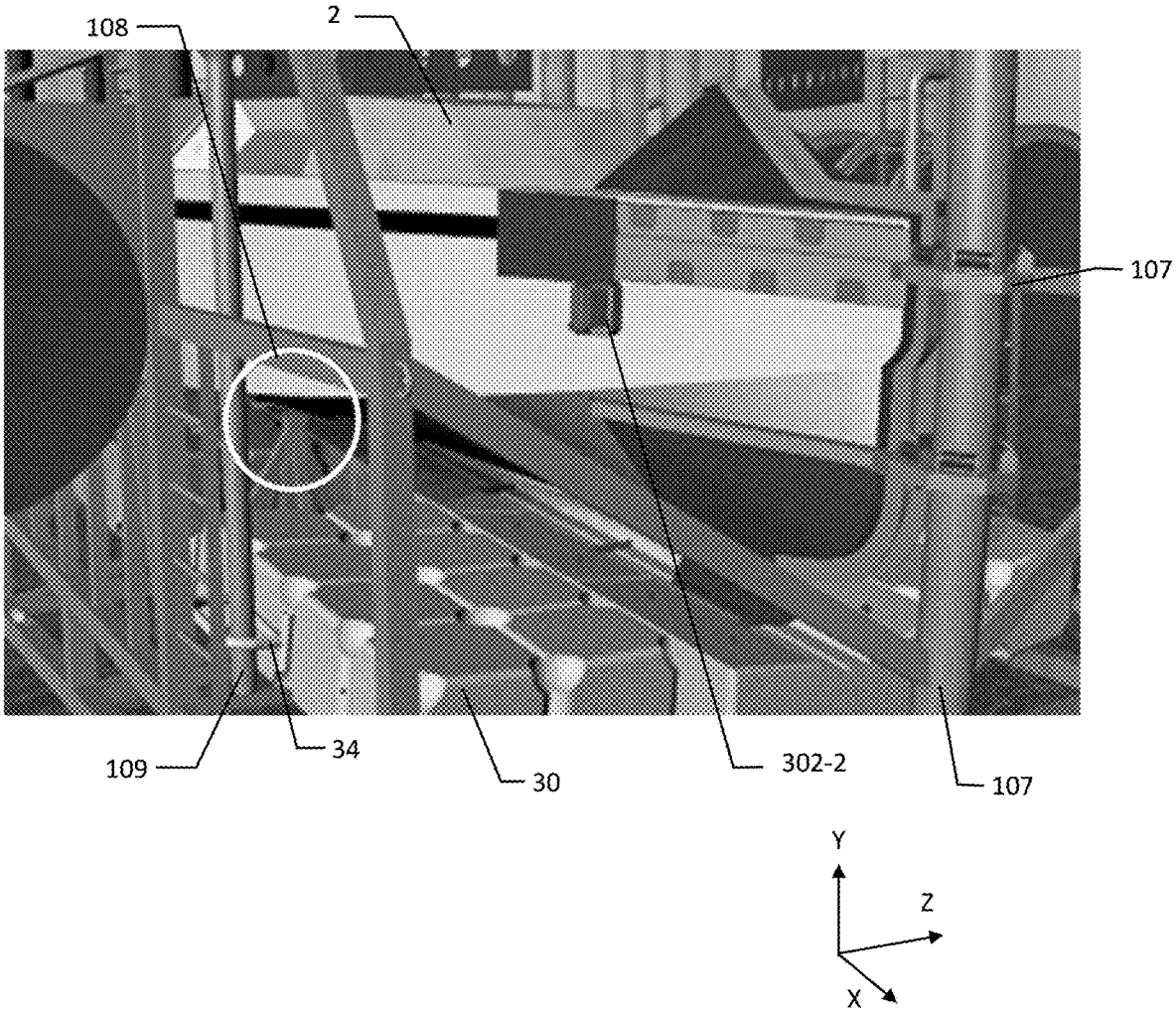
FIG. 3 shows an illustration describing an embodiment of a boat launch and recovery platform according to an embodiment of the invention.
Figure 4:
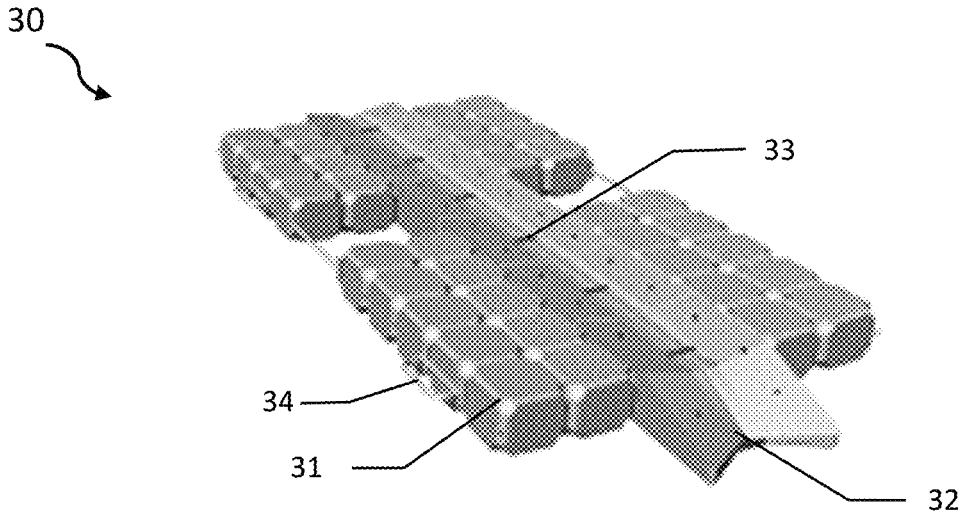
FIG. 4 shows an illustration of a floating floor of a boat launch and recovery platform according to the invention.

When out of the water, the boat 2 may rest at least partially on the floating floor 30 which in turn rests on the support floor 11. Alternatively, the support floor 11 may form a cradle comprising a plurality of skids 108. This embodiment has been illustrated in particular in FIGS. 2 and 3. In this configuration, the floating floor 30 will rest on the support floor 11, but the boat 2 will not rest on the floating floor 30 but on the skids 108 associated with the cradle formed by the support floor 11. This has the advantage of maintaining a forward inclined position of the boat 2 when stored out of the water, but also retains the mechanical properties of the floating floor as it will not be crushed by the boat 2.

Thus, out of the water, the boat 2 received by the launch and recovery platform 1 will be positioned in a safe position in which the engines of the boat 2 will be raised allowing an easier inspection and less risk of tipping or damage when handling the loaded platform 1.

Furthermore, in this configuration, and as illustrated in FIG. 8, when the launch and recovery platform 1 is launched, the floating floor 30 will be arranged to float on the water surface S1. Advantageously, since the engines of a boat have a significant weight, the boat will be slightly inclined and at least part of the propellers of the one or more engines may be submerged. Thus, while the platform allows for out-of-water securing, it also allows for the boat to be put into a configuration in which it can autonomously move away from the platform afloat without additional handling.

Furthermore, as can be observed from the illustration in FIG. 8, the floating floor 30 is advantageously arranged so as to include, in the afloat position, a plane forming an angle α of at most 30° with the water surface S1. Thus, it allows the boat 2 to rest on the surface of the water and preferably slightly tilted backwards so that its one or more propellers or the one or more water intakes of its one or more propulsion waterjets are arranged below the surface S1 of the water. It will therefore automatically be in position to leave the platform 1. When the floating floor 30 is not formed of a single plane then the angle is preferably calculated between the longitudinal axis of the floating floor 30 and a plane formed by the water surface S1.

In addition, the floating floor 30 may be arranged so as to include, in the afloat position, a plane forming an angle Δ of at least 10° with respect to the support floor 11 of the frame 10. Preferably, the angle Δ will be at least 20°, preferably at least 25°. Indeed, advantageously, the platform 1 allows the boat to be tilted from a forward tilted out-of-water position to a rearward tilted afloat position, and this without the help of cylinders or other motorized systems. When the floating floor 30 is not formed of a single plane then the angle is preferably calculated between the longitudinal axis of the floating floor 30 and the longitudinal axis of the support floor 11.

In some embodiments, the support floor 11 may form the lower base 12 of the launch and recovery platform 1. Thus, it will not be possible to differentiate between these two elements and there will be no particular angles. Nevertheless, the support floor 11, as already mentioned, may include the plurality of skids 108. These skids 108 may be arranged so that the longitudinal axis of the boat 2 supported by said plurality of skids 108 forms an angle β with respect to the support floor 11 greater than or equal to 10°, preferably greater than or equal to 15°, more preferably greater than or equal to 20°, even more preferably greater than or equal to 25°. This angle β will generally be less than 60°. Preferably, the angle may be between 10° and 40°, preferably between 20° and 35°, even more preferably between 25° and 30°. When the floating floor is not formed of a single plane then the angle is preferably calculated between the longitudinal axis of the floating floor and a plane formed by the lower base 12.

In particular, the plurality of skids 108 may have lengths selected so as to induce such an angle and thus a forward tilt of the boat when the platform 1 is out of the water.

A launch and recovery platform 1 according to the invention may include a securing system 3 of the boat 2.

Figure 9:
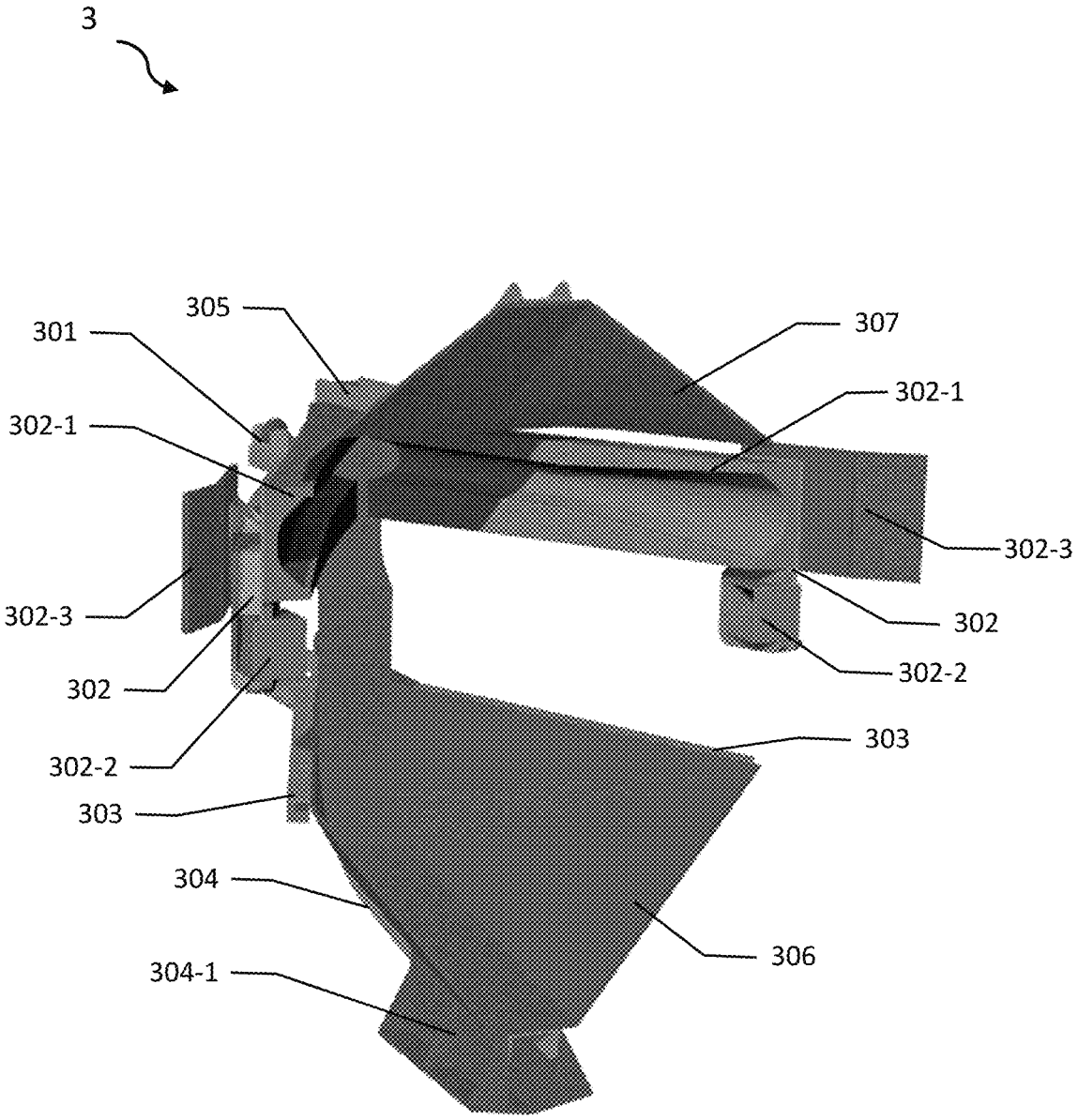
FIG. 9 shows an illustration of an embodiment of a system for guiding and securing a boat to a launch and recovery platform according to the invention.

As described in connection with FIG. 9, such a securing system 3 comprises a structure for receiving a boat 2. It may also include at least two guide arms 302.

Preferably, the docking structure is formed by a lower section 304 and an upper section 305 and is arranged to conform to the shape of part of the bow of the boat 2. Preferably, the docking structure of the boat 2 may be rotomolded.

The securing system 3 is advantageously fixed, via attachment means 301, to the launch and recovery platform 1, in particular to a profile 107 dedicated to stowing the boat 2.

In order to limit the stresses applied to the profile 107 when the boat 2 is stowed, the attachment means 301 of the securing system 3 may be arranged to form a sliding connection with the profile 107 dedicated to stowage and to allow a vertical movement of the securing system 3, preferably with respect to the lower base. Indeed, this may be advantageous when the launch and recovery platform 1 is deployed in a sea with significant wave movements.

In order to hold the boat 2 once stowed, the securing system 3 advantageously comprises two guide arms 302 extending radially from the docking structure towards the boat 2. The guide arms 302 are arranged to hold the boat 2 once in the docking structure of the securing system 3. In particular, they will be able to guide the bow within the frame during the forward translation of the boat in a process where the more the boat 2 moves forward, the more it centers.

To facilitate guiding and centering of the boat 2, the guide arms 302 may include lateral centering members 302-1 which may include grooves adapted to receive part of the bow of the boat 2. The lateral centering elements 302-1 may be formed from a rigid or semi-rigid material suitable for allowing shock absorption between the boat 2 and the securing system 3 and consequently the launch and recovery platform 1. For example, the lateral centering elements 302-1 may be made of plastic or a polymer adapted to undergo elastic deformation and return to its original shape after being deformed. In addition, the lateral centering elements 302-1 may be adapted to stiffen upon impact and return to their original shape after impact.

In any case, the lateral centering elements 302-1 preferably comprise a recess adapted to receive a guide element, such as a rail, positioned on either side of the bow of the boat 2. Preferably, the recess may have a decreasing width from a first end of the lateral centering member 302-1 to a second end of the lateral centering member 302-1. By way of an illustrative example, the lateral centering element 302-1 may have a funnel shape to facilitate insertion and passage of the guide rail and thus holding the boat 2 by the guide arms 302. Thus, the boat 2 can be centered by means of a double guide along a horizontal axis and along a vertical axis. In particular, the securing system 3 is arranged such that the further the boat advances within the frame, the more closely the securing system 3 conforms to the shape of the bow (reduced degree of movement between the floor and the securing system 3) and therefore the more precise its centering. This easy and precise three-dimensional centering can advantageously be coupled with locking the boat 2 in position.

In order to improve the gripping and thus the holding of the boat 2 by the securing system 3, said securing system may comprise lateral locking elements 302-2. The lateral locking elements 302-2 are advantageously positioned on each guide arm 302 and formed by a metallic alloy or a rigid polymer. Preferably so as to form strikers into which cylinders can be locked. Alternatively, they may be carried by other profiles and be independent of the guide arms 302.

Figure 6:
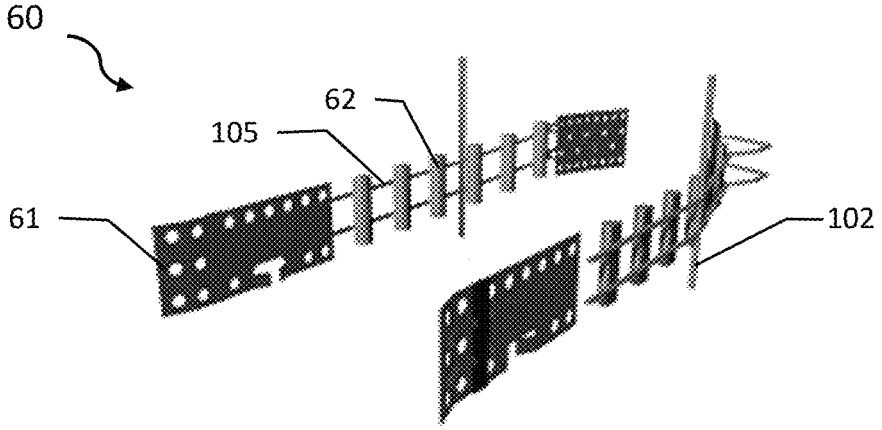
FIG. 6 shows an illustration of a damping and guiding system of a boat launch and recovery platform according to the invention.

Each of the locking elements 302-2 may have a suitable housing or shoe acting as a striker to receive an end of a cylinder positioned on the boat 2. Indeed, as can be seen in FIG. 6, the locking element 302-2 is positioned substantially against the hull of the boat 2 once the bow of the latter comes into contact with the docking structure of the securing system 3. Advantageously, a hydraulic cylinder may be positioned at the contact surface between the hull of the boat 2 and the locking member 302-2 so as to hold the boat 2 and minimize shocks between the boat 2 and the launch and recovery platform 1. The housing or shoe adapted to receive one end of a cylinder positioned on the boat 2 may advantageously be removable and replaceable.

For example, the boat 2 may have two hydraulic cylinders retracted on either side of the bow. The two cylinders are preferably positioned just below the guide rails of the boat 2 so that when the bow of the boat 2 comes into contact with the docking structure of the securing system 3, each hydraulic cylinder is positioned opposite a locking element 302-2 acting as a striker.

In order to further limit the mechanical stresses exerted by the boat 2 on the securing system 3 and consequently on the launch and recovery platform 1, the securing system 3 may comprise a plurality of damping elements. The main function of the damping elements is to absorb the shocks of the boat 2 on the securing system 3 in order to avoid any deformation of the docking structure and in particular of the lower 304 and upper 305 profiles. To this end, the damping elements may be made of a material such as that described in connection with the lateral centering elements 302-1.

Thus, the securing system 3 may comprise a damping element forming a shoe 304-1 attached to the lower profile 304 and arranged to dampen an impact between the boat 2 and the floating floor 30. In addition, the lower profile 304 may comprise two support arms 303 extending radially from the docking structure toward the boat 2. The two support arms 303 are arranged to allow the attachment of a damping element forming a lower cover 306 covering the entire lower profile 304. The lower cover advantageously has a shape adapted to the nose of the boat 2, formed in part by the bow of the boat 2, which is thus positioned in abutment against the lower cover 306, helping to hold the boat 2 in place and protecting it from abrasion. Advantageously, the shoe 304-1 is removably or irremovably attached to the floating floor. For example, part of the floating floor could be formed of integral floats allowing a solid junction associated with the shoe to be made.

Similar to the lower cover 306, the securing system 3 may comprise a damping element forming an upper cover 307. Advantageously, the upper cover 307 is attached to the upper profile 307 covering the entire upper profile 305. The upper cover 307 advantageously has a shape adapted to the nose of the boat 2, formed in part by the bow of the boat 2, which is thus positioned in abutment against the upper cover 307, helping to hold the boat 2 in place and protecting it from abrasion.

Finally, the securing system 3 may comprise a damping element forming a bumper 302-3 attached to the guide arms 302 and arranged to dampen an impact between the boat 2 and the frame 10 of the launch and recovery platform 1.

Thus, such a securing system 3 allows the boat 2 to be held in a launch and recovery platform 1 according to the invention and prevents any damage to the boat 2, to the securing system 3, and to the launch and recovery platform 1, in particular by minimizing or even avoiding rolling, surging, pitching, yawing and/or heaving movements that may generate such damage.

Furthermore, all the damping elements are interchangeable wearing parts, that is to say said damping elements are removably attached.

Figure 5:
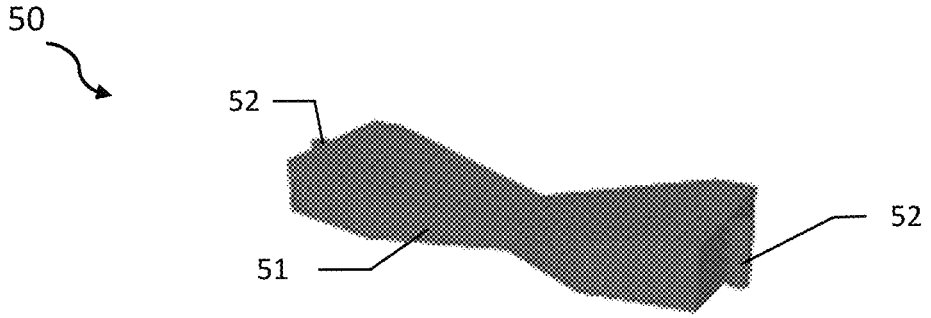
FIG. 5 shows an illustration of a floating cradle of a boat launch and recovery platform according to the invention.

As illustrated in FIG. 5, the launch and recovery platform 1 according to the invention may also include a floating cradle 50, preferably made of polymer or polymer composite positioned at the entrance to the enclosure formed by the profiles of the frame 10, preferably attached to at least a third profile of the profile assembly. Such a floating cradle 50 allows support of the hull at the level of the engines of the boat 2, thus relieving the stresses on the hull structure when the launch and recovery platform 1 is afloat. The buoyancy of this floating cradle can be adjusted by partially ballasting it to regulate the recovery of stresses and the trim of the boat 2 on the floor 30 when afloat.

The launch and recovery platform 1 according to the invention may include ballasts 40 positioned opposite said opening to enable the trim of the assembly to be adjusted during lifting.

As illustrated in FIG. 2 or 7, in order to enable the positioning of flotation means, the profile assembly forming the frame 10 may comprise at least one longitudinal profile 105 positioned on one side or preferably both sides of the frame. Preferably, the profile assembly forming the frame 10 comprises two parallel longitudinal profiles 105 positioned on both sides in the extension of the entrance to the enclosure, respectively.

As illustrated in FIG. 6, the launch and recovery platform 1 may include guide means 61 and a plurality of fenders 62. These elements will facilitate the positioning of the boat 2 within the frame 10.

The guide means 61 may take the form of slides covering in particular the entrance to the frame 10, said slides being fixed to the ends of the longitudinal profiles 105 of the frame 10 facilitating, on the one hand, the entrance of the boat 2 and, on the other hand, its positioning at the securing system 3 in the launch and recovery platform 1.

Preferably, the guide means 61 may take the form of tubes, tube sections, skids, inflatable air chambers, or rubber or polymer rollers.

The guide means 61 may, for example, correspond to guide rails fixed to each of the longitudinal profiles 105 and positioned at the entrance to the launch and recovery platform 1.

The fenders 62 may advantageously be fixed to all or part of each of the longitudinal profiles 105 in order to dampen and protect the boat 2 as it enters or leaves the launch and recovery platform 1.

In particular, the profile assembly may include at least one longitudinal profile 105 positioned on a face adjacent the enclosure entrance and adjacent the support floor 11, said longitudinal profile further including the guide means 61 and a plurality of fenders 62.

The guide means 61 and the plurality of fenders 62 are advantageously fixed to the longitudinal profiles 105.

The launch and recovery platform 1 can be used in the absence of any engine. Indeed, it can be designed to be moored to a quay, to be anchored in open water, or to be stored out of the water.

The platform 1 may also be equipped with wheels or skids to allow it to be launched and removed from the water on an inclined plane or slipway. It can be moved by means of a cable and a winch located on the slipway or on the platform 1. The wheel system may also be driven by motors powered by an electrical or hydraulic device located on the platform 1.

Alternatively, the launch and recovery platform 1 may be equipped with one or more motors enabling it to move, preferably autonomously, in the water, whether or not it is loaded with a boat. In particular, the platform 1 may include electric motors capable of dynamically positioning the platform 1, for example relative to the boat 2. Thus, the platform 1 may include a control module configured to allow remote control of the platform and/or autonomous navigation.

The platform 1 can also be equipped with communication means such as radio, GSM or satellite and/or localization with, for example, a GNSS (Geolocation and Navigation by Satellite System) system. In particular, the communication means may be configured to establish a relay between the boat and a ship or marine structure wishing to control or communicate with the boat 2.

In addition, the launch and recovery platform 1 can be equipped with energy storage systems, whether in the form of electrical energy, fuel cells, or fossil fuels. Thus, such a platform can be used to at least partially refuel the boats received at the frame 10. The energy stored on board (for example batteries) may be needed by the platform 1 to power navigation lights or communication equipment when present.

Furthermore, as described, the platform 1 may include one enclosure for receiving one boat 2, but it may also include several enclosures or one enclosure for receiving several boats 2.

When using the platform 1 described above, no operator on the platform or swimmer around the platform is required to launch or recover a boat. Thus, according to another aspect, the invention relates to the use of a launch and recovery platform 1 according to the invention as an autonomous receptacle of a boat 2.

As presented, such a platform is particularly relevant in the context of a method of launching or recovering a boat at sea and in particular when the sea is rough.

Thus, according to another aspect, the invention relates to a method 200 of launching a boat 2.

Figure 10:
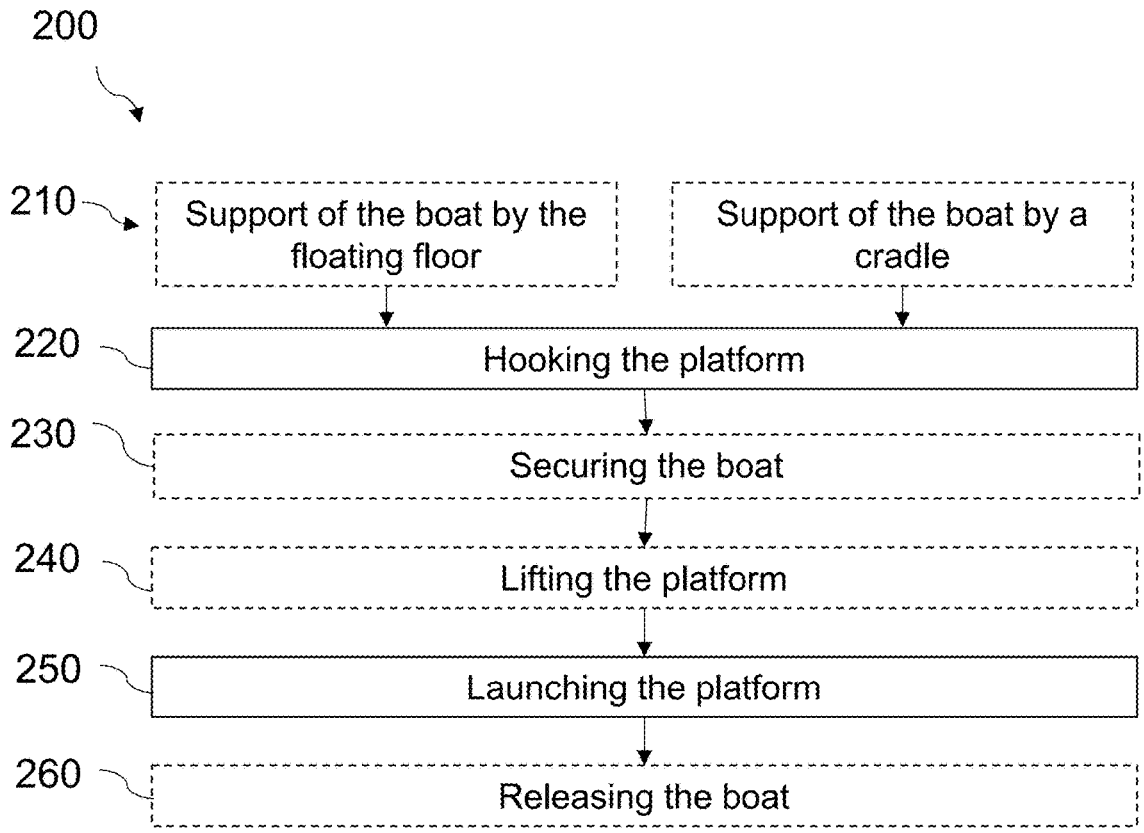
FIG. 10 shows a diagram of a method of launching a boat according to an embodiment of the present invention.

A method of launching a boat 2 is illustrated in FIG. 10 and it preferably uses a launch and recovery platform 1 according to the invention.

Such a method may include a step of lifting 240 the launch and recovery platform 1 supporting the boat 2, and a step of launching 250 said launch and recovery platform comprising the boat 2.

It may also include a step of supporting 210, by the floating floor 30, the boat 2 in the launch and recovery platform 1. Alternatively, the launching method 200 may include a step of supporting 210 the boat 2 by a cradle of the launch and recovery platform 1. In addition, the launching method 200 may include a step of hooking 220 the launch and recovery platform 1 comprising the boat 2.

The boat 2 can be positioned in the launch and recovery platform 1 when out of the water. Nevertheless, advantageously, the boat 2 can be positioned in the launch and recovery platform 1 when afloat. The boat 2 can be lifted, for example by a crane and launched independently with a set of 4 slings, same as the launch and recovery platform 1, after which the boat 2 enters the launch and recovery platform 1 when afloat.

When the boat 2 has already been positioned at the frame 10, before it is launched, the boat may be supported by the floating floor 30 or by a cradle, said cradle preferably including a plurality of skids 108.

A method of launching a boat 2 according to the invention also includes a step of hooking 220 the launch and recovery platform 1 comprising or not the boat 2.

The method according to the invention may include a step of securing 230 the boat 2, prior to the step of lifting 240 the launch and recovery platform 1, within the frame 10. Specifically, this securing step 230 may in particular include embedding the bow of the boat 2 in a docking structure of the frame 10.

In addition, the securing step 230 may include actuating articulated arms establishing a connection between the frame 10 and the boat 2. These articulated arms can be positioned on the boat 2 or on the frame 10. Preferably they are positioned on the frame 10 and more particularly within a securing system 3. Nevertheless, the securing step 230 may preferably include actuating articulated arms positioned on the boat 2 establishing a connection between the frame 10 and the boat 2. More preferably, the securing step may preferably involve locking the cylinders integrated into the hull of the boat 2 into the locking elements 302-2 acting as strikers.

Advantageously, the guide arms 302 of the platform 1 according to the invention will be flexible with a spring effect or actuated by bearing on a stop on the bow of the boat causing a lever effect. The guide arms 302 will preferably be configured to fit into a dedicated housing or rail positioned on the frame 10 or on the boat 2, and preferably on the boat 2.

The lifting step 240 of the launch and recovery platform 1 supporting or not the boat 2 may be performed by a lifting means such as a crane.

The method according to the invention includes a particular step of launching 250. Classically, the launching step 250 may be performed by a lifting means such as a crane or by sliding or rolling by means of a winch or wheels with motorized hubs on an inclined plane, a ramp, or a slipway.

Classically, this launching step involves the transition of the launch and recovery platform 1 from an out-of-water position to an afloat position.

Finally, the method according to the invention may include a step of releasing 260 the boat 2. Contrary to the securing step 230, the releasing step 260 may include actuating articulated arms such as guide arms 302 establishing a connection between the frame 10 and the boat 2. Preferably, the guide arms 302 will be configured to disengage from a dedicated housing or rail to allow the boat 2 to exit the launch and recovery platform 1.

Nevertheless, advantageously, in the out-of-water position, the floating floor 30 rests on the support floor 11 whereas in the afloat position the floating floor 30 floats on the surface S1 of the water.

In these two positions, the boat 2 will preferably rest at least partially on the floating floor 30 and more preferably it will not rest entirely on the floating floor 30.

Even more preferably, in the out-of-water position, the boat 2 rests on a plurality of skids 208 associated with a cradle formed by the frame 10. As described, the cradle can be formed by the support floor or by the lower base.

According to another aspect, the invention relates to a method 400 of removing a boat 2 from the water.

Figure 11:
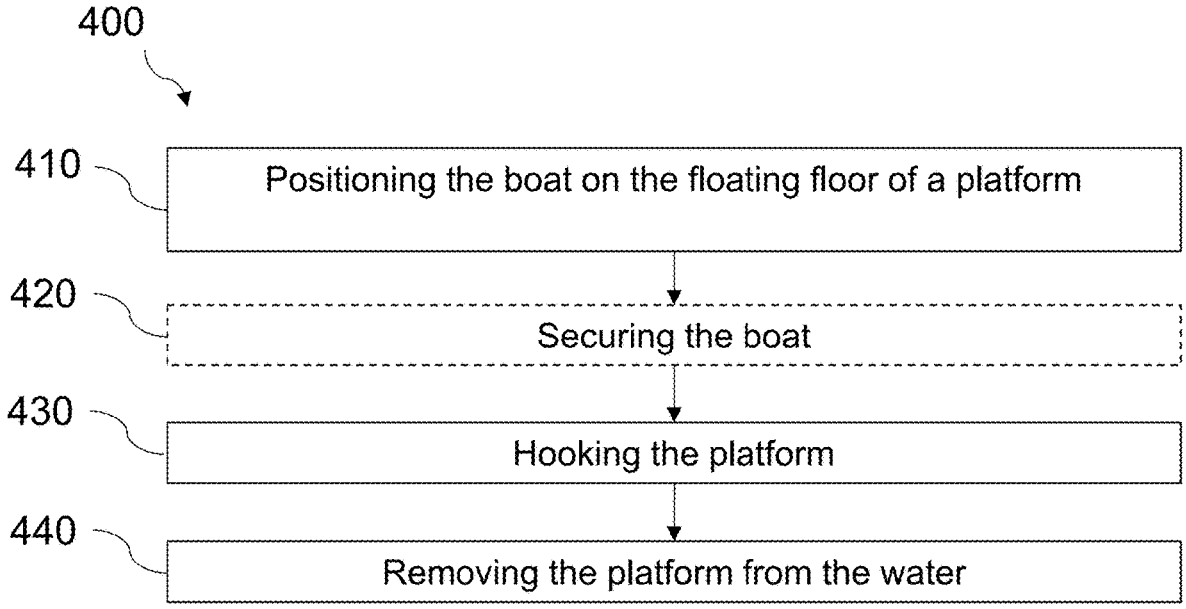
FIG. 11 shows a diagram of a method of removing a boat from the water according to an embodiment of the present invention.

A method of removing 400 a boat 2 from the water is illustrated in FIG. 11 and it preferably uses a launch and recovery platform 1 according to the invention.

The method 400 of removing from the water may include a step of positioning 410 the boat 2 on the floating floor 30 of a launch and recovery platform 1, said launch and recovery platform 1 preferably corresponding to the platform 1 according to the present invention. The positioning step may include moving the boat 2 so as to engage the entrance to the enclosure of the frame 10. This may be facilitated by the presence of guide means 61.

The method 400 of removing the boat from the water may also include a step of securing 420 the boat 2 within the frame 10. In particular, this securing may include embedding the bow of the boat 2 in a docking structure of the frame 10.

In addition, the securing step may include actuating articulated arms such as guide arms 302 establishing a connection between the frame 10 and the boat 2. These articulated arms can be positioned on the boat 2 or on the frame 10. Preferably they are positioned on the frame 10, and more particularly within a securing system 3.

The guide arms 302 will preferably be configured to fit into a dedicated housing or rail positioned on the frame 10 or on the boat 2, and preferably on the boat 2.

Preferably, the securing step may involve locking the cylinders integrated into the hull 2 into the locking elements 302-2 acting as strikers.

The method 400 of removing from the water according to the invention further includes a step of hooking 430, to a recovery means, said launch and recovery platform 1 comprising the boat 2. The recovery means can be a lifting means such as a crane, but also any means capable of extracting a platform from the water such as a motor or winch associated with a ramp, wheels with motorized hubs on an inclined plane, or a slipway.

The hooking step 430 may be followed by a step of removing from the water 440 said launch and recovery platform 1 comprising the boat 2. This step can be performed by a recovery means. The recovery can be done by lifting, but also by sliding or rolling. This step of removing from the water 440 will result in the transition from an afloat position in which the floating floor 30 floats on the surface S1 of the water to an out-of-water position in which the floating floor 30 rests on the support floor 11.

Furthermore, this step of removing from the water 440 will cause the transition from an afloat position in which the boat rests at least partially on the floating floor 30, and preferably therefore substantially horizontal or with the bow raised, to a position in which the boat rests on the floating floor or on a cradle with the stern of the boat raised, facilitating in particular certain maintenance operations.

Thus, the present invention provides a solution for launching and receiving the boat which can be operated simply, without risk for operators, and which is effective especially in rough seas. In addition, such a solution facilitates subsequent maintenance operations on a boat.

The foregoing description of the various embodiments has been presented for illustration and description purposes. It is not intended to be exhaustive or to limit the invention to the precise forms described, and, of course, many modifications and variations are possible in the light of the above teaching. The example embodiments, as described above, have been selected and described to best explain the principles of the invention and its practical application so as to enable others skilled in the art to best use the invention in various embodiments and with various modifications appropriate to the particular use contemplated. It is intended that the scope of the invention be defined by the attached claims.

The invention claimed is:

1. A boat launch and recovery platform comprising:

a frame for receiving a boat, said frame including a profile assembly forming an enclosure comprising an entrance and a support floor, flotation means attached to the frame, and a floating floor coupled to the frame so as to be vertically translatable, the floating floor being an independently buoyant surface, said launch and recovery platform being arranged to transition from a configuration in which the floating floor rests on the support floor when the launch and recovery platform is out of water, to a configuration in which the floating floor floats on a surface of the water when the launch and recovery platform is afloat.

2. The launch and recovery platform according to claim 1, wherein the frame is made of metal or a metal alloy such as steel.

3. The launch and recovery platform according to claim 1, further comprising a securing system, said securing system including a docking structure for the boat arranged so as to conform to a shape of part of a bow of the boat and at least two guide arms arranged to hold the boat.

4. The launch and recovery platform according to claim 3, wherein the docking structure is arranged so as to be vertically translatable with respect to a lower base of the frame, preferably the docking structure is, furthermore, fixed to the floating floor.

5. The launch and recovery platform according to claim 1, wherein the floating floor includes a means of attachment to the frame selected from the group consisting of: a slider-type connection, a ring equipped with runners sliding on a tube, a rail, and a ring capable of sliding on a vertical structure of the frame.

6. The launch and recovery platform, according to claim 1, wherein the floating floor comprises at least one connecting ring arranged to surround at least one guide bar fixed to the frame.

7. The launch and recovery platform according to claim 1, wherein the support floor forms a cradle comprising a plurality of skids for supporting the boat when said launch and recovery platform is in the out-of-water configuration.

8. The launch and recovery platform according to claim 7, wherein the floating floor comprises a plurality of openings arranged to allow positioning of the plurality of skids under the boat when said launch and recovery platform is in the out-of-water configuration.

9. The launch and recovery platform according to claim 1, wherein the floating floor is arranged so as to support the boat at least partially when said launch and recovery platform is in the out-of-water configuration.

10. The launch and recovery platform according to claim 1, further comprising a lower base, separate from the support floor, said support floor having a plane forming, with respect to the lower base, an angle (β) greater than or equal to 10°.

11. The launch and recovery platform according to claim 1, wherein the support floor forms a cradle comprising a plurality of skids, said support floor forms a lower base of the launch and recovery platform, and the plurality of skids have lengths selected so that a longitudinal axis of the boat supported by said cradle forms an angle (β) with respect to the support floor greater than or equal to 10°.

12. The launch and recovery platform according to claim 1, further comprising at least one, preferably at least four lifting rings for cooperating with a lifting means.

13. The launch and recovery platform according to claim 1, further comprising a floating cradle positioned at the entrance to the enclosure formed by the profile assembly of the frame.

14. The launch and recovery platform according to claim 1, further comprising guide means and a plurality of fenders.

15. An autonomous receptacle for a boat comprising the launch and recovery platform according to claim 1.

16. A method of launching a boat by means of the launch and recovery platform according to claim 1, said method comprising:

hooking the launch and recovery platform supporting the boat, and putting in the water said launch and recovery platform comprising the boat, thereby causing the transition from the out-of-water configuration in which the floating floor rests on the support floor to the afloat configuration in which the floating floor floats on the surface of the water and in which the boat rests at least partially on the floating floor.

17. A method of removing a boat from the water, said method comprising:

positioning the boat on the floating floor of the launch and recovery platform according to claim 1, hooking, to a recovery means, said launch and recovery platform comprising the boat, removing from the water, using the recovery means, said launch and recovery platform comprising the boat, thereby causing the transition from the afloat configuration in which the floating floor rests substantially on the surface of the water to the out-of-water configuration in which the floating floor rests on the support floor.

18. The method of removing from the water according to claim 17, further comprising securing the boat including actuating locking cylinders establishing a connection between the frame and the boat.

* * * * *